US006494492B1

(12) United States Patent
Ha

(10) Patent No.: US 6,494,492 B1
(45) Date of Patent: Dec. 17, 2002

(54) SUCTION PIPE OF A VACUUM CLEANER

(76) Inventor: Jong Mok Ha, 102-1007 Samsung Apt. 63-9, Myung jang-Dong, Dongrae-Gu, Pusan (KR)

( * ) Notice: Subject to any disclaimer, the term of this patent is extended or adjusted under 35 U.S.C. 154(b) by 0 days.

(21) Appl. No.: 09/242,908

(22) PCT Filed: Feb. 9, 1999

(86) PCT No.: PCT/KR99/00062

§ 371 (c)(1),
(2), (4) Date: Feb. 25, 1999

(87) PCT Pub. No.: WO00/08997

PCT Pub. Date: Feb. 24, 2000

(51) Int. Cl.[7] ..... A47L 9/24; F16L 35/00
(52) U.S. Cl. ..... 285/7; 285/303
(58) Field of Search ..... 285/7, 303, 305, 285/308

(56) References Cited

U.S. PATENT DOCUMENTS 3,049,367 A * 8/1962 Lashta ..... 285/7
3,351,363 A * 11/1967 Downey et al. ..... 285/303
4,989,295 A 2/1991 Guhne et al.
5,332,266 A * 7/1994 Canale ..... 285/303
5,692,782 A * 12/1997 Fischer ..... 285/303
5,836,620 A 11/1998 Wang et al.
5,941,575 A 8/1999 Herbst
5,954,370 A * 9/1999 Pietersen ..... 285/7
6,237,962 B1 * 5/2001 Lim ..... 285/303

FOREIGN PATENT DOCUMENTS

EP 0553482 A1 12/1992
EP 0552481 A1 7/1993
EP 0812561 A1 12/1997
GB 1088640 * 10/1967 ..... 285/7

* cited by examiner

*Primary Examiner*—Eric K. Nicholson
(74) *Attorney, Agent, or Firm*—Birch, Stewart, Kolasch & Birch, LLP

(57) ABSTRACT

The present invention is related to a suction pipe of a vacuum cleaner which permits arbitrary stretching and control of the length of the suction pipe which is combined with a vacuum cleaner. The suction pipe of results in a more compact and stable operational structure whose length can be controlled arbitrarily. An outer pipe is drawn from an inner pipe by sliders elastically combined to the outer side of the outer pipe in the longitudinal direction. The movement of the sliders in any one direction detaches stoppers from respective control homes of the inner pipe. The stoppers are combined with their control homes when the sliders are returned to their original locations.

8 Claims, 8 Drawing Sheets

SUCTION PIPE OF A VACUUM CLEANER

This application is the national phase under 35 U.S.C. §371 of prior PCT International Application No. PCT/KR99/00062 which has an International filing date of Feb. 9, 1999 which designated the United States of America.

TECHNICAL FIELD

The present invention relates to a suction pipe of a vacuum cleaner, particularly to a suction pipe of a vacuum cleaner which is convenient in using by having the length of a suction pipe, which is connected to a vacuum cleaner and suctions dust and other materials into a vacuum cleaner, selected and controlled arbitrarily.

BACKGROUND ART

Conventional vacuum cleaners have performed cleaning by forcefully drawing out waste materials such as dust, etc. through a suction pipe by using the vacuum suction force. Suction pipes of such vacuum cleaners have had a fixed length or their constitutional elements have been composed of in the simple separation and combination method making their use by controlling the length as desired by a user according to the height of the user, location and part of cleaning, and other conditions very difficult.

In other words, the suction pipe of conventional vacuum cleaners has been composed of two to four pipe bodies in the separation and combination method so that its length may be controlled. However, the suction pipe having such separation combination structure has been disadvantageous in that it is not possible to control its length in detail in many steps, it is not possible to keep the cleaner compactly and to move after using due to the length, and subsequently, volume of the suction pipe, and other aspects.

And there have been many products supplementing the above disadvantages and enhancing more convenience so that the length of a suction pipe may be stretched or controlled arbitrarily. However, they have been disadvantageous in that their operation is unstable, they are not convenient in using due to difficulty in controlling and manipulating the length, their appearances are not very nice due to projection of the control lever, etc. as they are constructed in such a way that the length of the suction pipe may be variably controlled by manipulating the control lever, and therefore, the length of the suction pipe is controlled by manipulating the somewhat complicatedly structured control lever.

DISCLOSURE OF INVENTION

An object of the present invention is therefore to solve problems and disadvantages of the suction pipe of conventional vacuum cleaners enabling easy control of the length of the suction pipe as desired by making it relatively simple structured thus increasing convenience in using of the vacuum cleaner and raising competitiveness of the product with improved appearance. Particularly, the present device has a compact-structured control means in order to ensure convenience in using according to the manipulation of control of the length of the suction pipe to the maximum and to provide nice-looking products.

BRIEF DESCRIPTION OF DRAWINGS

The foregoing and other objects, aspects and advantages will be better understood from the following detailed description of preferred embodiments of the invention with reference to the drawings, in which.

BEST MODE FOR CARRYING OUT THE INVENTION

Figure 1:
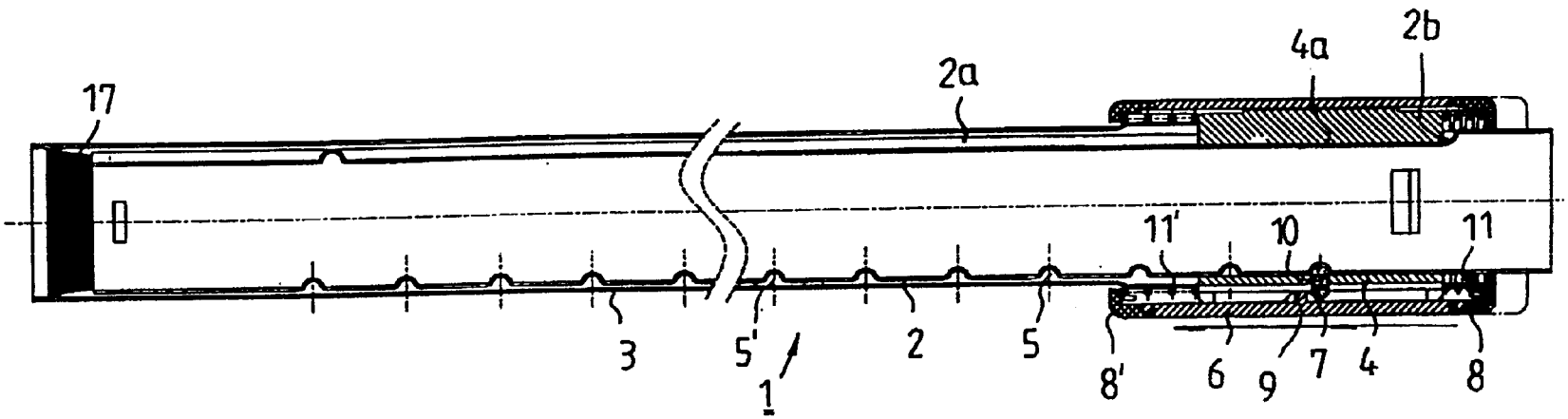
FIG. 1 is a cross-sectional view of one preferred embodiment of the present device.
Figure 2:
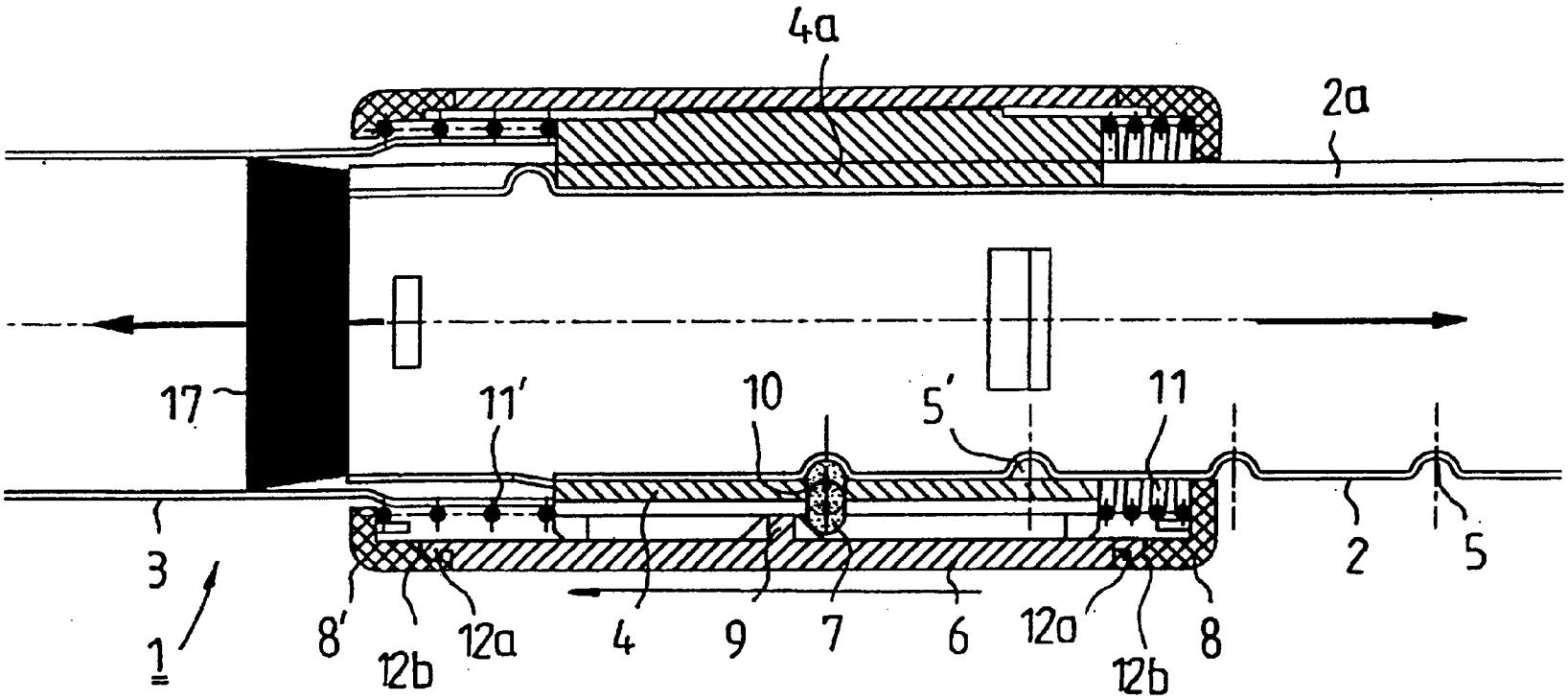
FIG. 2 is an enlarged cross-sectional view of the essential part of the present device.
Figure 3:
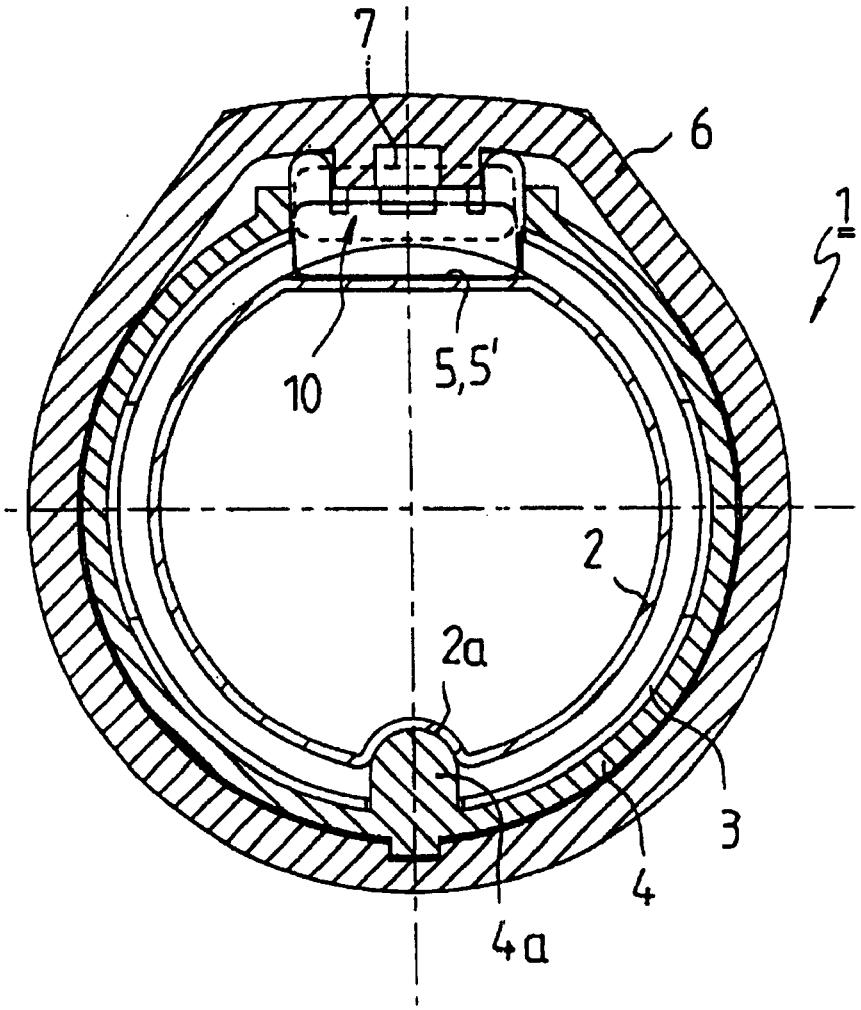
FIG. 3 is a transverse cross-sectional view of the present device.
Figure 4:
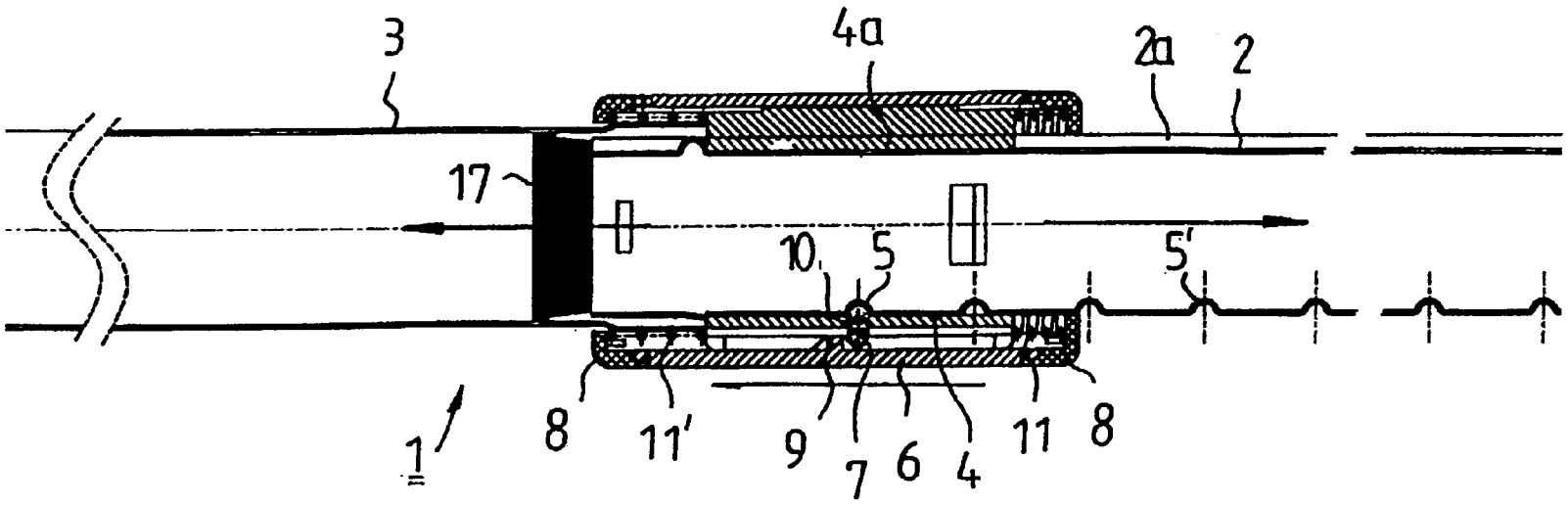
FIG. 4 is a cross-sectional view of the present device showing its operational state.

FIG. 1 is a cross-sectional view of one preferred embodiment of the present device, and FIG. 2 is an enlarged cross-sectional view of the essential part of the present device. In the suction pipe 1 of a vacuum cleaner in which an inner pipe 2 connected to the vacuum cleaner and an out pipe 3 of which suction inlet is mounted at the end are connected to each other and draw dust and other waste materials out of the suction inlet of the out pipe 3 into the vacuum cleaner, the present device is characterized by that the length of the suction pipe 1 may be controlled arbitrarily by slide-connecting inner and out pipes 2, 3 to stretch and control. The construction of the present device is described in more detail as follows:

A guide pipe 4 is connected to the end of an out pipe 3 which is connected to the outer side of an inner pipe 2 connected to a vacuum cleaner. In the guide pipe 4, a projected part 4*a* is formed so that the projected part 4*a* is connected to the concave guide inlet 2*a* of the inner pipe 2 as it is fixedly inserted into the out pipe 3. In the linear side of the concave guide inlet 2*a*, a hook 2*b* is formed so that the projected part 4*a* of the guide pipe 4 connected to the concave guide inlet 2*a* is caught by the look 2*b* , and the out pipe 3 is not allowed to rotate arbitrarily (avoid idle running) from the inner pipe 2 by the projected part 4*a* which is connected to the concave guide inlet 2*a*. In this state, the out pipe 3 and inner pipe 2 slide along the concave guide inlet 2*a* when they are drawn out or inserted.

A multiple number of control homes 5, 5' are formed in a row in the above inner pipe 2, and the guide pipe 4 is equipped with an elevation ball 10 so that a stopper 7 may move up and down as the stopper 7 passes through control homes 5, 5' of the inner pipe 2. The length of the suction pipe 1 is then controlled according to the position of the inner pipe 2 to be drawn out of the out pipe 3 or inserted as the position of control homes 5, 5', to which the stopper 7 is hooked and connected, is selected by having the stopper 7 installed in the elevation ball 10 hooked and fixed selectively to one of control homes 5, 5' through the elevation ball 10 of the guide pipe 8.

Also, a slider 6 is connected to the outer side of the guide pipe 4 in which the elevation ball 10 is formed. Caps 8, 8' are connected to both sides of the slider 6, and springs 11, 11' are installed elastically inside of both caps 8, 8'. Formed inside of the slider 6 is a switch 9 which is located on top of the elevation ball to open and close the elevation ball 10. The stopper 7 is then hooked to or released from control homes 5, 5' of the inner pipe 2 as the switch 9 controls up-and-down movement of the stopper 7 which is located in the elevation ball 10.

The slider 6 and caps 8, 8' of both sides in the above are assembled interactively in terms of male and female assembly protrusion 12 and concave assembly home 12*a* so that the slider 6 and caps 8, 8' of both sides are not rotated idly. And springs 11, 11' which are built in caps 8, 8' of both sides of the slider 6 are supported by a fixture 13 in caps 8, 8' so that springs 11, 11' are stably and elastically combined in the lengthwise direction to support the guide pipe 4 elastically from both sides.

Figure 5:
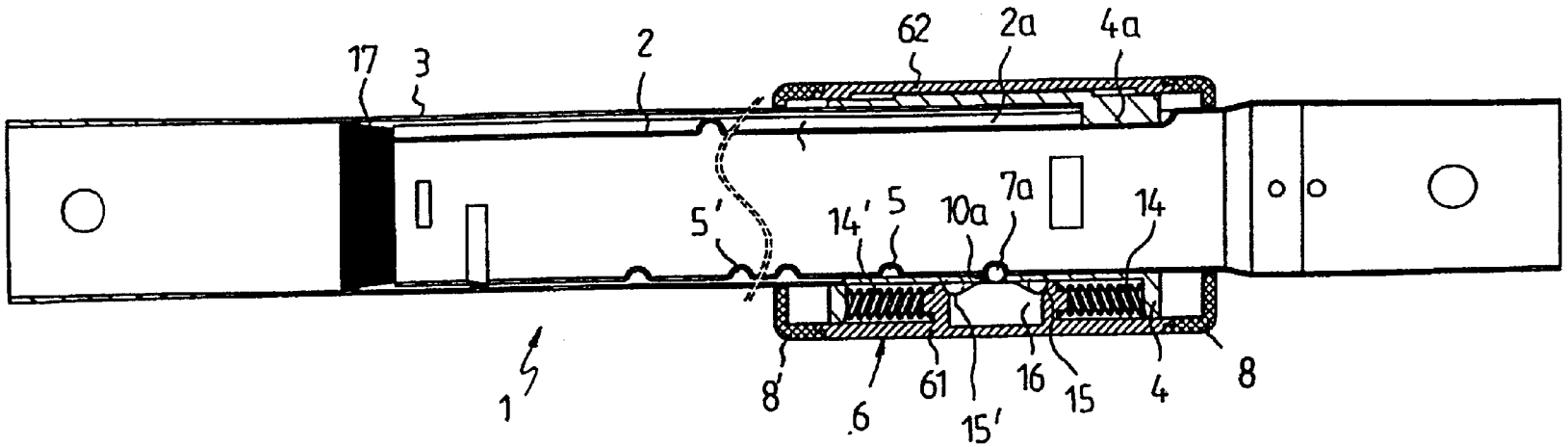
FIG. 5 is a cross-sectional view of another preferred embodiment of the present device.
Figure 6:
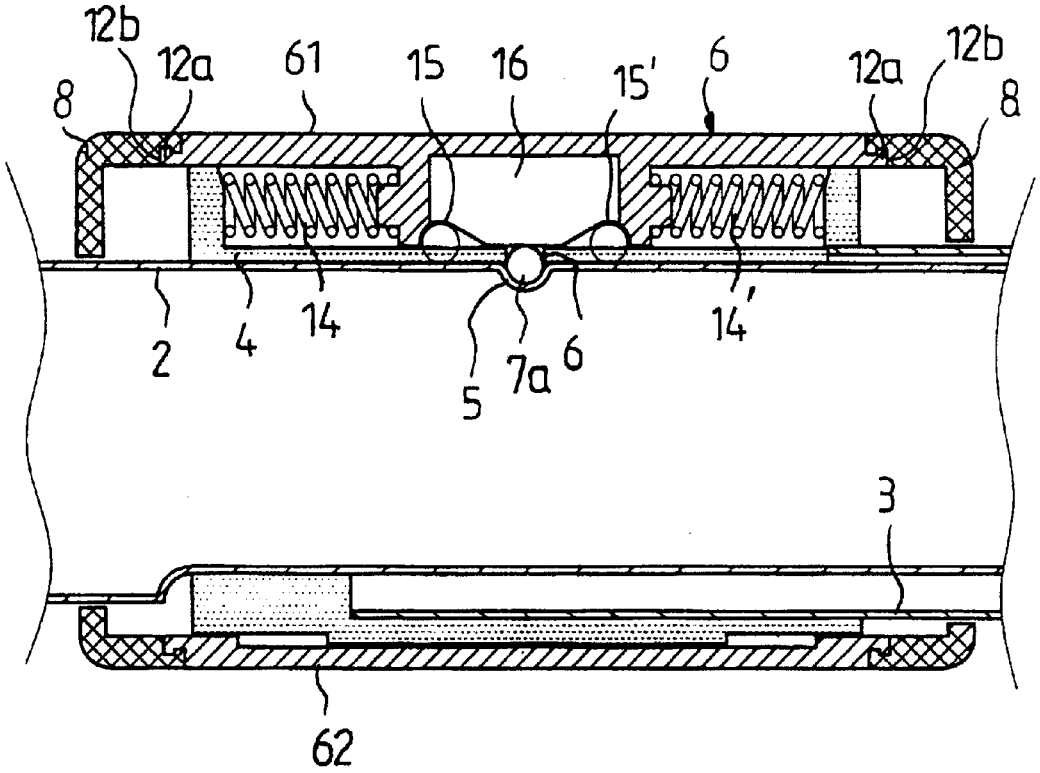
FIG. 6 is an enlarged cross-sectional view of the essential part of the present device of FIG. 5.

FIG. 5 is a cross-sectional view of another preferred embodiment of the present device, and FIG. 6 is an enlarged cross-sectional view of the essential part of the present device of FIG. 5. As in the above-described one preferred embodiment of the present device, to one end of the out pipe 3 which is connected to the outer side of the inner pipe 2 connected to a vacuum cleaner, a guide pipe 4 is connected in such a way that the length of the suction pipe 1 is stretched and controlled by moving the out pipe 3 from the inner pipe 2 as the guide pipe 4 is moved.

The guide pipe 4 is connected to the out pipe 3 to form the elevation ball 10*a* through which the roller-type stopper 7*a* is raised from control homes 5, 5' of the inner pipe 2 and to combine elastically springs 14, 14' to both ends so that the slider 6*a* which is connected to the outer side of the guide pipe 4 can be moved in the lengthwise direction.

At the center of the above slider 6*a*, there is an operational part 16 which is composed of catching homes 15, 15' at both sides which are elastically supported by the above springs 14, 14' and through which the stopper 7*a* can be hooked or detached from control homes 5, 5' of the inner pipe 2 as the stopper 7*a* is raised through the elevation ball 10*a* when the slider 6*a* is moved in the right-and-left lengthwise direction. It is therefore possible to control the length of the suction pipe 1 by inserting, drawing out, and stretching the out pipe 3 from the inner pipe 2 by having the stopper 7*a* hooked to or detached from control homes 5, 5' as the slider 6*a* is moved.

The construction of the present device is illustrated in more detail as follows:

The above slider 6*a* is divided into an upper cover 61 and a lower cover 62 which are combined at the outer side of the guide pipe 4, and the central slider 6*a* of the upper cover 61 is combined within the operational part 16 through elastic support of springs 14, 14' of both sides.

Catching homes 15, 15' are inserted and formed at both sides of the bottom surface of the above slider 6*a* so that the stopper 7*a* is hooked and detached as it is raised from control homes 5, 5' of the inner pipe 2 through the elevation ball 10*a*. And as in the above-described one embodiment of the present device, caps 8, 8' are combined to both sides of the slider 6*a*.

The reference numeral 17 in the figure which is not yet illustrated is a packing pipe.

In the present device which is constructed as described in the above, if a slider 6 is operated slidingly in the lengthwise direction, a switch 9 in the slider 6 opens or closes the elevation ball through which a stopper 7, which is hooked and fixed to control homes 5, 5' of an inner pipe 2 when the inner pipe 2 is drawn out of an out pipe 3 or is inserted, is raised as the stopper 7 is detached from control homes 5, 5' as it is moved by drawing out or insertion of the inner pipe 2. If the slider 6 which is moved in one direction is released, the slider 6 is returned to its original position by the restoring force of springs 11, 11' which are elastically combined with caps 8, 8' of both sides. At this time, the switch 9 of the slider 6 closes the elevation ball 10, and the stopper 7 which is built in the elevation ball 10 keeps its original position which is hooked and fixed to control homes 5, 5' of any one side of the inner pipe 2 thus enabling arbitrary control of the length of the suction pipe 1 as the inner pipe 2 is drawn out of the out pipe 3 or is inserted. The operation of the present device is then illustrated in more detail as follows:

If the slider 6 slides in any one direction, caps 8, 8' which are combined to both sides of the slider 6 are moved along in the direction of movement of the slider 6, by which springs 11, 11' at one side (opposite side of the direction of movement of the slider 6) in caps 8, 8' formed at both sides are compressed to the guide pipe 4 side which is fixed to the out pipe 3.

If the slider 6 is moved in any one direction, the slider 6 compresses springs 11, 11' of one direction, while the switch 9 opens the elevation ball 10 of the guide pipe 4 as the slider 6 is moved.

Accordingly, if the inner pipe 2 is drawn out of the out pipe 3 (length is reduced) or inserted (length is extended), the stopper 7 which has been hooked to control homes 5, 5' is raised through the elevation ball while overcoming the load of control homes 5, 5' by the moving force of the inner pipe 2.

In other words, the stopper 7 which has been hooked to control homes 5, 5' is raised, as it is released to the circumference of the inner pipe 2 along control homes 5, 5' by the moving force of the inner pipe 2 as the switch 9 of the slider 6 stopping the elevation 10 is open, is completely located at the circumference of the inner pipe 2, and again passes through control homes 5, 5' of another side. The length is controlled as the above processes are performed repetitively. If the slider 6 is released with the inner pipe 2 drawn out or inserted by the user in a proper length, the slider 6 is returned to its original position by the restoring force of springs 11, 11' which have been compressed in one direction, and the switch 9 of the slider 6 closes the elevation ball 10 of the guide pipe 4 as in the beginning.

Therefore, the stopper 7 which is hooked to any one of control homes 5, 5' selected is not raised any further in the elevation ball 10 by the switch 9 stopping the elevation ball 10, and its state of being hooked to control homes 5, 5' of the inner pipe 2 is fixedly maintained thus enabling selection of the length of the suction pipe 1.

The stopper 7 which is hooked to control homes 5, 5' of the inner pipe 2 is not raised in the closed elevation ball 10 but remains to be fixed although it is moved to draw the inner pipe 2 out of the out pipe 3 or to insert since the switch 9 of the slider 6 always stops the elevation ball 10 unless the slider 6 is moved, and control homes 5, 5' of the inner pipe 2 and the guide pipe 4 which is fixedly combined to the out pipe 3 maintain the combination relationship in terms of the stopper 7 thus enabling selective control of the length of the suction pipe 1.

And springs 11, 11' which are elastically combined with caps 8, 8' of the slider 6 at both sides of the guide pipe 4 are stably and elastically combined by a fixture 13 formed in caps 8, 8' at both sides of the slider 6 without moving to ensure smooth manipulation of the slider 6 and to provide stable operation of the slider 6 for control of the length. Also, caps 8, 8' at both sides of the slider 6 are interactively assembled by means of assembly protrusion 12 and concave assembly home 12*a* thus enabling their simple assembly and preventing idle running of the slider 6 and caps 8, 8' at both sides.

In the meantime, the stopper 7 which is installed in the elevation ball 10 of the guide pipe 4, is raised in the elevation ball 10 according to movement of the slider 6, and is hooked to or released from control homes 5, 5' of the inner pipe 2 can have a circular pin type, oval pin type, or other types. In the present device, it is desirable to give stable workability to the device by forming the stopper 7 in a lengthwise oval form to prevent the stopper 7 hooked to control homes 5, 5' when the elevation ball 10 is closed by the switch 9 of the slider 6 from moving up so that the state of being hooked is not released, and to hook or release the stopper 7 to or from control homes 5, 5' without completely departing from the elevation ball 10 but moving up in the elevation ball 10 when the elevation ball 10 is open from the switch 9 and the stopper 7 is released from the state of being hooked to control homes 5, 5' in contrast.

Figure 7A:
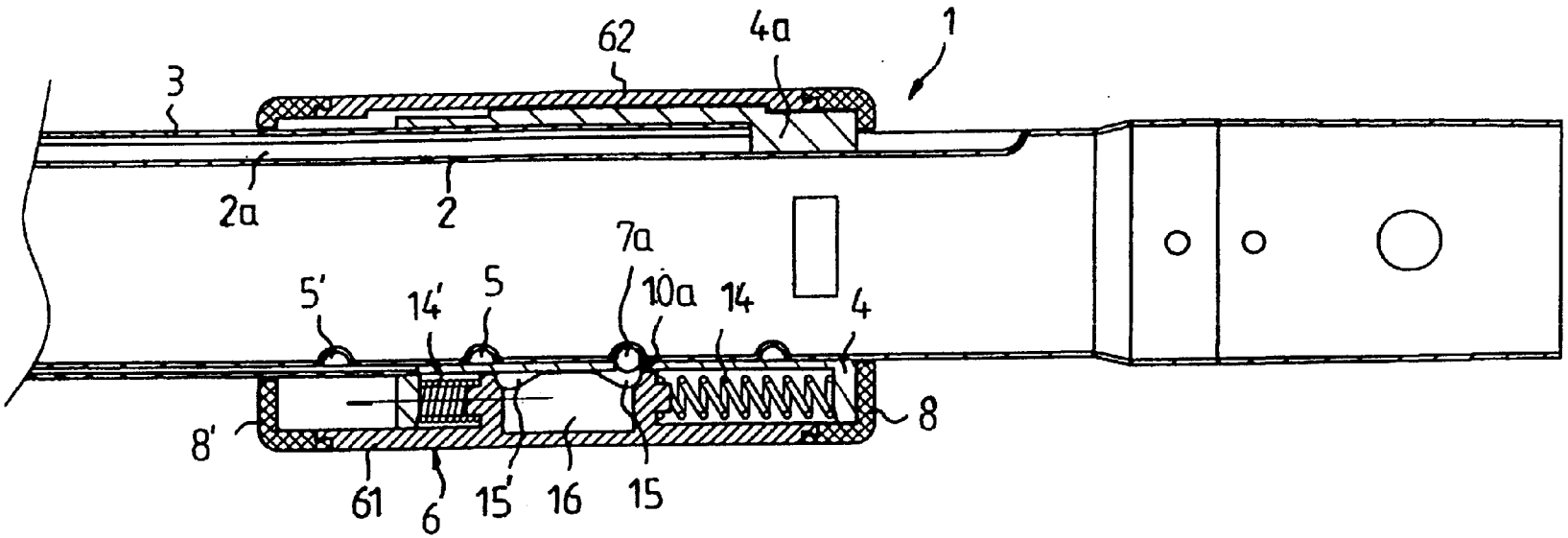
FIGS. 7*a* and 7*b* are cross-sectional views of the present device of FIG. 5 showing its operational state.
Figure 7B:
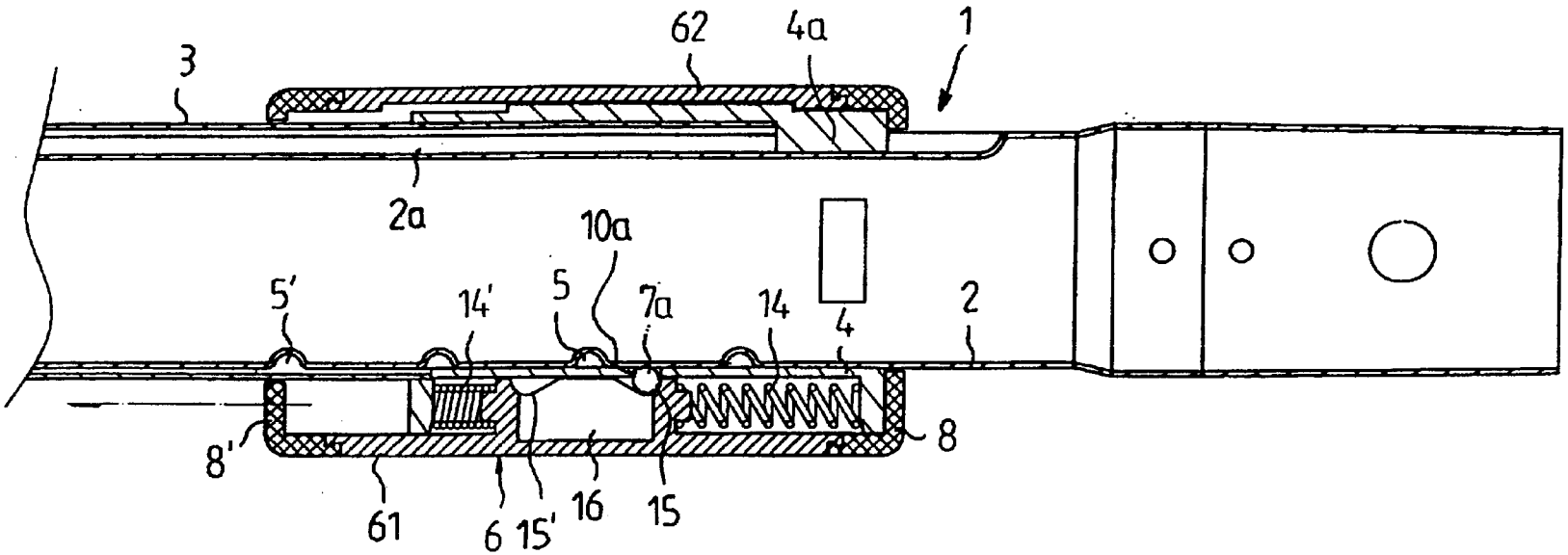

As shown in FIGS. 7*a* and 7*b*, if the slider 6*a* is moved in one direction in order to draw the out pipe 3 out of the inner pipe 2, the operational part 16 of the slider 6*a* compresses the spring 14' of one side while it is moved in one direction at the outer side of the guide pipe 4. As the spring 14' is compressed, the catching home 15 of one side is coincided with the elevation ball 10*a*, and the stopper 7*a* which is hooked to control homes 5, 5' of the inner pipe 2 is raised to the catching home 15' side through the elevation ball 10*a* and is detachable from control homes 15, 15'.

In other words, if the slider 6*a* is moved to one side as described in the above, the guide pipe 4 is moved naturally as the operational part 16 which is an integral part of the slider 6*a* is moved. The out pipe 3 to which the guide pipe 4 is combined is then moved, and the stopper 7*a* which has been hooked to control homes 5, 5' is positioned to the rear catching home 15 side of the bottom surface of the slider 6*a* through the elevation ball 10*a* along the circumference of the inner pipe 2. By controlling movement of the slider 6*a*, the out pipe 3 is moved from the inner pipe 2 as much as desired.

When drawing the out pipe 3 out of the inner pipe 2 by pushing the slider 6*a* in one direction as described in the above, the stopper 7*a* is moved as it is hooked or detached selectively to or from catching home 15 of the slider 6*a* and the control home 5,5' side of the inner pipe 2. In other words, the stopper 7*a* is hooked to the catching home 15 of the slider 6*a* if the elevation ball 10*a* is located at the circumference of the inner pipe 2 through the elevation ball 10*a* which is formed in the operational part 16 of the guide pipe 4 moving along with the slider 6*a*, or is lowered to the control home 5, 5' side if the elevation ball 10*a* is located at control homes 5, 5' while moving. That is, the stopper 7*a* is instantaneously combined to either the catching home 15 or control 5, 5' side.

Therefore, a user desiring to extend the length of the suction pipe 1 by drawing out the out pipe 3 from the inner pipe 2 can extend and control the length of the suction pipe 1 as desired by manipulating the slider 6*a* in the forward direction, moving the out pipe 3 as desired by pushing the guide pipe 4, and releasing the slider 6*a*, as the slider 6*a* is returned to its original position by the restoring force of the spring 14' which has been compressed at one side of the operational part 16 of the slider 6*a*, and the stopper 7*a* of the catching home 15 is hooked to control homes 5, 5' of the inner pipe 2 through the elevation ball 10*a*.

In the same way, a user desiring to reduce the length of the suction pipe 1 by inserting the out pipe 3 to the inner pipe 2 can reduce and control the length of the suction pipe 1 as described in the above by pulling the slider 6*a* in the opposite direction, compressing the spring 14 of the opposite side of the operational part 16, and moving the out pipe 3 to the inner pipe 2 side with the stopper 7*a* hooked to the catching home 15' contrary to the time of drawing out.

As described in the above, in the present device, it is possible to arbitrarily control the length of the suction pipe 1 in one-touch manipulation by simply holding and pushing the sliders 6, 6*a* in the desired direction or by simply releasing the sliders 6, 6*a* at a selected length as the out pipe 3 is moved in the desired direction or the out pipe 3 and inner pipe 2 are interactively fixed to each other, respectively.

INDUSTRIAL APPLICABILITY

As apparent from the foregoing, the present invention enables very simple control of the length of the suction pipe 1 in one-touch manipulation by stretching the out pipe 3 from the inner pipe 2 as desired. The present device is advantageous and effective in that the device ensures convenience in using of a vacuum cleaner to the maximum since the length of the suction pipe 1 may be arbitrarily controlled as desired due to its further simplified and convenient operation; removes inconvenience in keeping and moving the device since the suction pipe 1 may be reduced compactly; provides compact and clean appearance of the suction pipe 1 since the sliders 6, 6*a* which are means for variably controlling the length of the suction pipe are not of projected form but of planar form; contributes to the improvement of design of vacuum cleaners; and for other reasons.

While the invention has been described in terms of a few preferred embodiments, those skilled in the art will recognize that the invention can be practiced with modification within the spirit and scope of the appended claims.

What is claimed is:

1. A suction pipe of a vacuum cleaner, wherein a length of said suction pipe may be controlled by inserting or drawing out an outer pipe to or from an inner pipe, said suction pipe comprising:

a guide pipe connected to the outer pipe;

a sliding unit movable in relation to said guide pipe in a longitudinal direction of said outer pipe;

a first spring and a second spring;

a first control home and a second control home formed in said inner pipe and fixedly connecting said inner pipe; and an oval stopper pin hookable in either of said pair of control homes formed in said inner pipe and fixedly connecting said guide pipe and said inner pipe, wherein said oval stopper pin is biased by a spring force of the first spring and the second spring, said second spring exerting a second spring force in an adjusted position of said suction pipe on said oval stopper pin equivalent to a first spring force of the first spring but in an opposite direction.

2. A suction pipe according to claim 1, wherein said guide pipe includes an aperture supporting said oval stopper pin, said oval stopper pin moveable upwardly and downwardly within said aperture into a released position and a hooked position, respectively.

3. A suction pipe according to claim 1, wherein said guide pipe includes an aperture supporting said oval stopper pin, said oval stopper pin moveable upwardly and downwardly within said aperture into a released position and a hooked position, respectively.

4. A suction pipe according to claim 1, wherein said sliding unit includes a switch facing said guide pipe, said switch securing said oval stopper pin in an adjusted position of said outer pipe in a control home.

5. A suction pipe according to claim 1, wherein said sliding unit includes a switch facing said guide pipe, said switch securing said oval stopper pin in an adjusted position of said outer pipe in a control home.

6. A suction pipe according to claim 3, wherein said sliding unit includes a switch facing said guide pipe, said switch securing said oval stopper pin in an adjusted position of said outer pipe in a control home.

7. A suction pipe according claim 1, said sliding unit including a pair of outer ends and a cab on each respective outer end coupling said first and second spring elastically with said guide pipe.

8. A suction pipe according claim 3, said sliding unit including a pair of outer ends and a cab on each respective outer end coupling said first and second spring elastically with said guide pipe.

* * * * *